US007115294B1

(12) United States Patent
Loh et al.

(10) Patent No.: US 7,115,294 B1
(45) Date of Patent: Oct. 3, 2006

(54) COMBINATION HOT DOG AND BEVERAGE DISPENSER

(76) Inventors: Bill Loh, 441 Cola Ballena, Alameda, CA (US) 94501; Robert S. Smith, 1263 Emory St., San Jose, CA (US) 95126

( * ) Notice: Subject to any disclaimer, the term of this patent is extended or adjusted under 35 U.S.C. 154(b) by 0 days.

(21) Appl. No.: 11/236,181

(22) Filed: Sep. 26, 2005

Related U.S. Application Data

(63) Continuation-in-part of application No. 10/998,279, filed on Nov. 23, 2004.

(51) Int. Cl.
*B65D 45/00* (2006.01)
*B65D 85/72* (2006.01)

(52) U.S. Cl. ..... 426/115; 426/85; 206/217; 206/541; 220/521

(58) Field of Classification Search ..... 426/120, 426/115, 112, 85, 86, 124; 206/217, 541, 206/223; 220/521, 23.86
See application file for complete search history.

(56) References Cited

U.S. PATENT DOCUMENTS 2,802,590 A * 8/1957 Tupper ..... 220/522
4,840,271 A * 6/1989 Garwood ..... 206/213.1
5,325,962 A * 7/1994 Ouellette ..... 206/229
6,021,903 A * 2/2000 Hanson ..... 206/541

FOREIGN PATENT DOCUMENTS

FR 2608131 * 6/1988 ..... 426/115

* cited by examiner

*Primary Examiner*—Reginald L. Alexander
(74) *Attorney, Agent, or Firm*—Robert Samuel Smith

(57) ABSTRACT

A container for bulk items of food, particularly hot dogs, comprising a box with a bottom side mountable on the top of a standard cup/can holding a beverage. A drinking straw is inserted through a side sleeve in the container and an opening in the top of the cup/can into the beverage. A lid is provided which, in one version, is attached along one edge to an edge of the tray. In one position, the lid covers the contents in the tray and in another position, the lid is laid open so that sauces are available for dipping an end of the hot dog in the sauce.

3 Claims, 5 Drawing Sheets

COMBINATION HOT DOG AND BEVERAGE DISPENSER

CROSS REFERENCE TO EARLIER FILED APPLICATIONS

This application is a continuation-in-part of application Ser. No. 10/998,279 filed Nov. 23, 2004 from which priority is claimed.

FIELD OF THE INVENTION

This invention relates to a package for dispensing bulk food items, particularly hot dogs and particularly to a package that engages the top of a beverage container.

BACKGROUND AND INFORMATION DISCLOSURE

Hot dogs have long been associated with one another like doughnuts and coffee, peanut butter and jelly, bacon and eggs. However, a unique problem exists with dispensing hot dogs and soft drinks in that they are often eaten when the diner is "on the move" such as through a crowd, shaking hands at a party.

Another problem with the "open dish" method of dispensing hot dogs is that, in the minds of many, the present practice of eating on the move is not conducive to protecting against the spread of bacteria.

SUMMARY OF THE INVENTION

It is an object of this invention to provide a combination dispenser of hot dogs and beverage that enables the user to hold the combination dispenser in one hand while eating/drinking, leaving the other hand free to answer a cell phone or shaking a hand or operating a steering wheel.

It is another object of this invention that the dispenser includes a "serving size package of nuts.

It is another object that the dispenser is sealable so that the hot dog is protected from contamination while until the time when the user is ready to eat and drink.

It is another object that the dispenser of the hot dog be configured to engage a can of beverage wherein the can is a standard can so that the hot dog dispenser be displayed and sold as a separate item from the can of beverage.

It is another object that the hot dog is packaged in a clean environment and amenable to inserting it directly into a microwave oven and warmed directly with no additional handling requirements.

This invention is directed toward a package for the hot dog that is engaged with the top of a beverage container.

The beverage container is a standard container known to the public as "one of a six pack".

The package includes a tray section having a bottom panel and a continuous side extending from the edge of the panel. A lid is provided to seal the open top of the tray until the user desires access to the hot dog.

In one embodiment, the lid is integrally joined along a straight section of its edge to a straight section of the tray. The lid has depressions for holding sauces (catsup, mustard, relish etc).

In use, the user lays back the lid and "squirts" the sauce into the depression.

Alternatively, the sauce is packaged in an envelope that is attached to the lid and the user discharges the sauce into the depression by squeezing the package.

A small (straw sized) hole in the bottom of the tray is provided through which the user can insert a straw extending down through the beverage stored in a can/cup.

DESCRIPTION OF A BEST MODE

Figure 1:
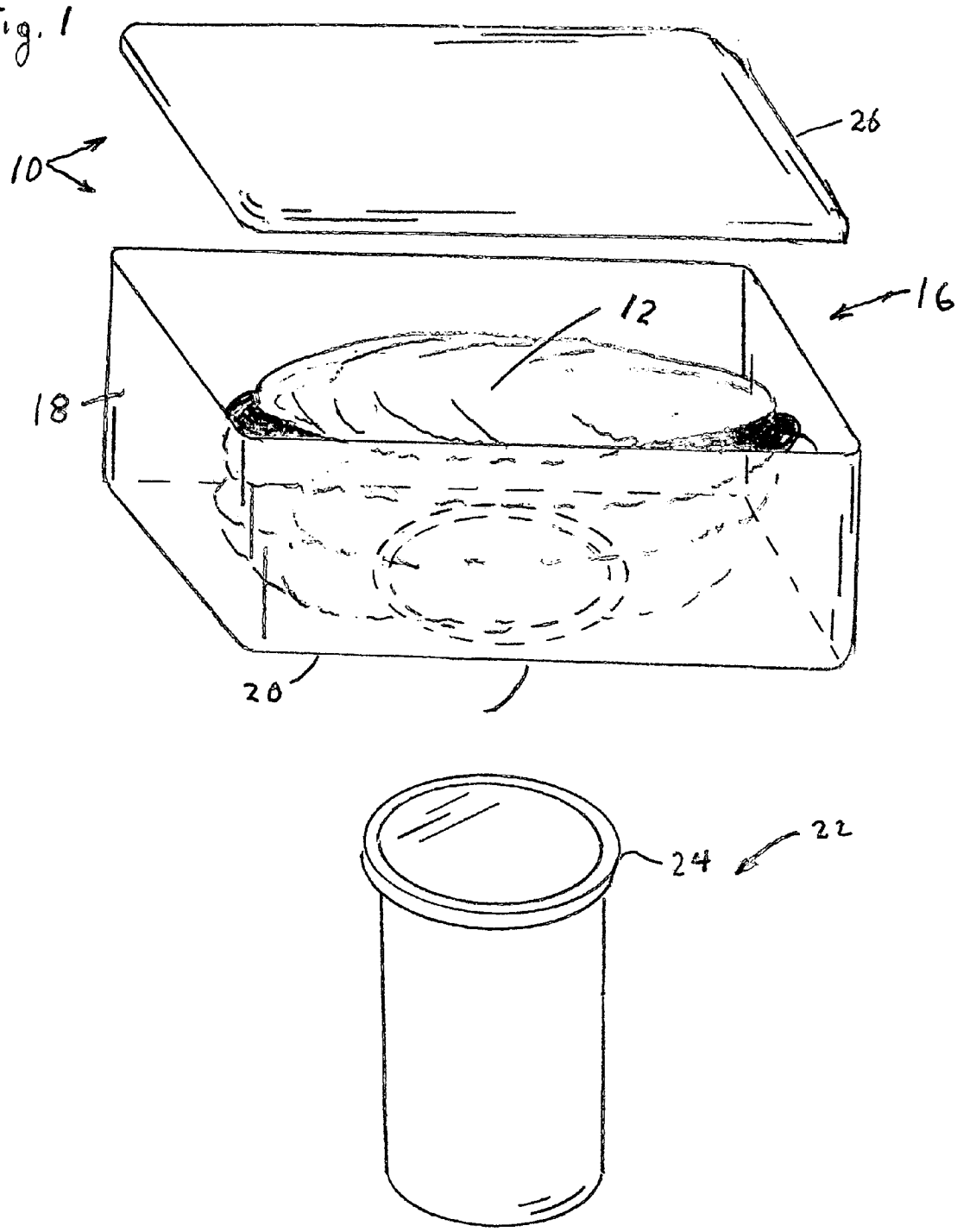
FIG. 1 is an assembly view of the container poised for attachment to the can.

Turning now to a description of the drawings, FIG. 1 shows a version of the invention being a container 10 for a hot dog configured for mounting on the top end of a standard beverage cup or can 14.

The container comprises an oblong box 16 having a continuous side extending from a substantially rectangular bottom side 20.

The dimensions of the box 16 are selected to enable storing a hot dog and bun 12 inside the box 16.

A lid is shown poised for positioning onto the opening of the box 16. The edge 28 of the lid 16 is configured to mate with the edge of the box 16 so that the lid "snaps" onto the box 16.

The box 16 is poised over a standard cup/can 22.

The standard cup/can has an outside ridge 24 around the upper edge of the cup/can 22.

Figure 2A:
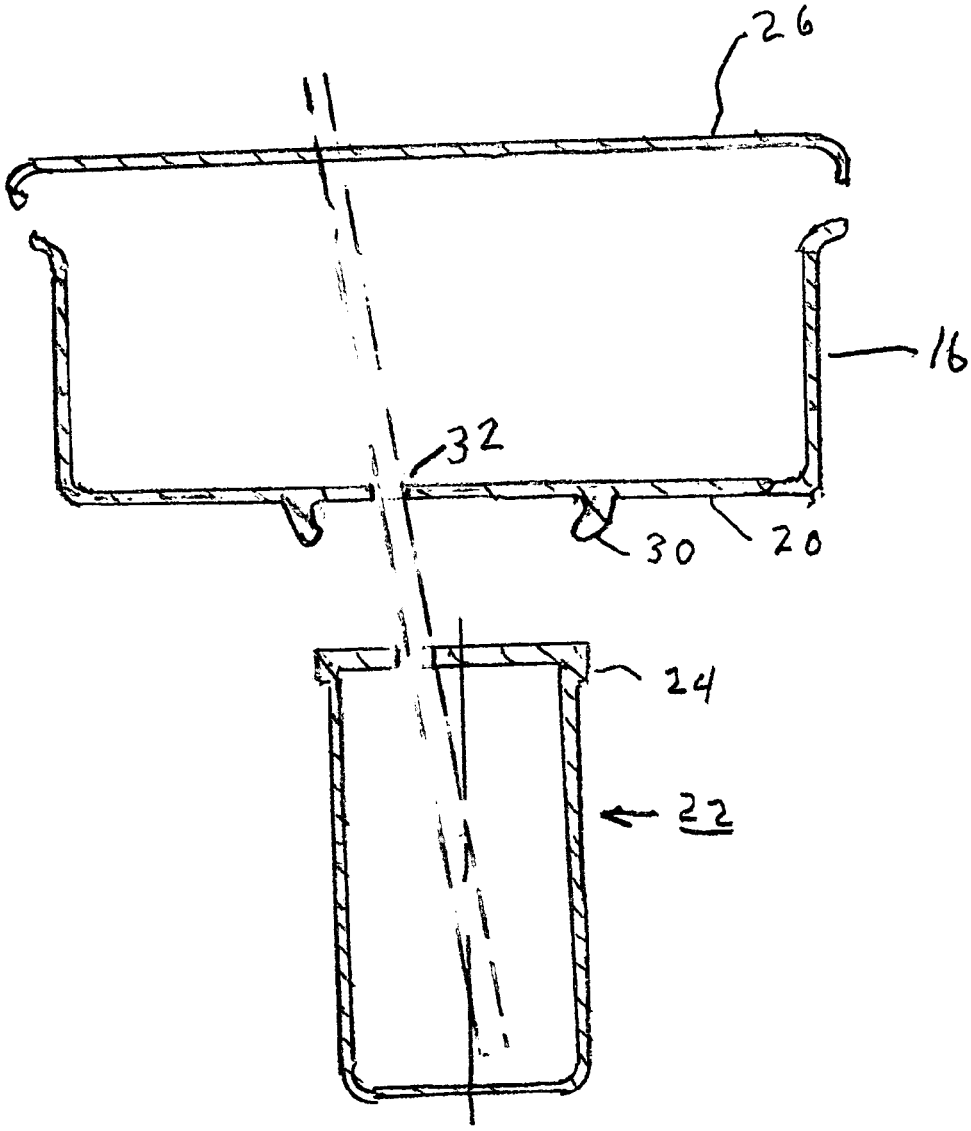
FIG. 2A is a sectional view of FIG. 1.

FIG. 2A is a sectional view of the box 16 showing a ridge on the bottom side 20 of the container for mounting ("snapping") the box 16 onto the top end of beverage can 22.

Figure 2B:
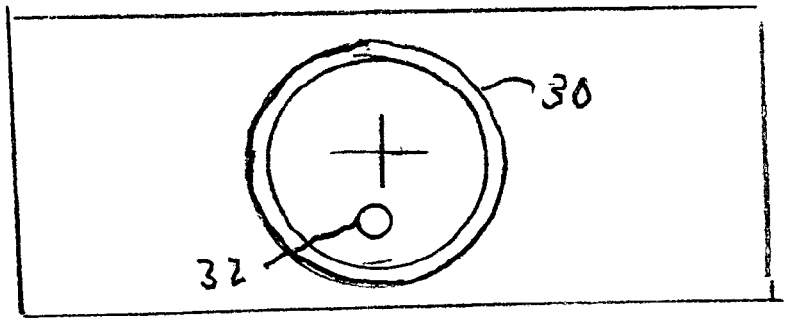
FIG. 2B is the same as 2A but also shown a drinking straw positioned inside the can.

FIG. 2B is a view of the bottom side 20 of the box 16 showing the ridge 30 that engages the rim 24.

The bottom of the box 16 also has an opening 32 so that, when the can is opened, a straw may be inserted into through an opening in the can 22.

Figure 3:
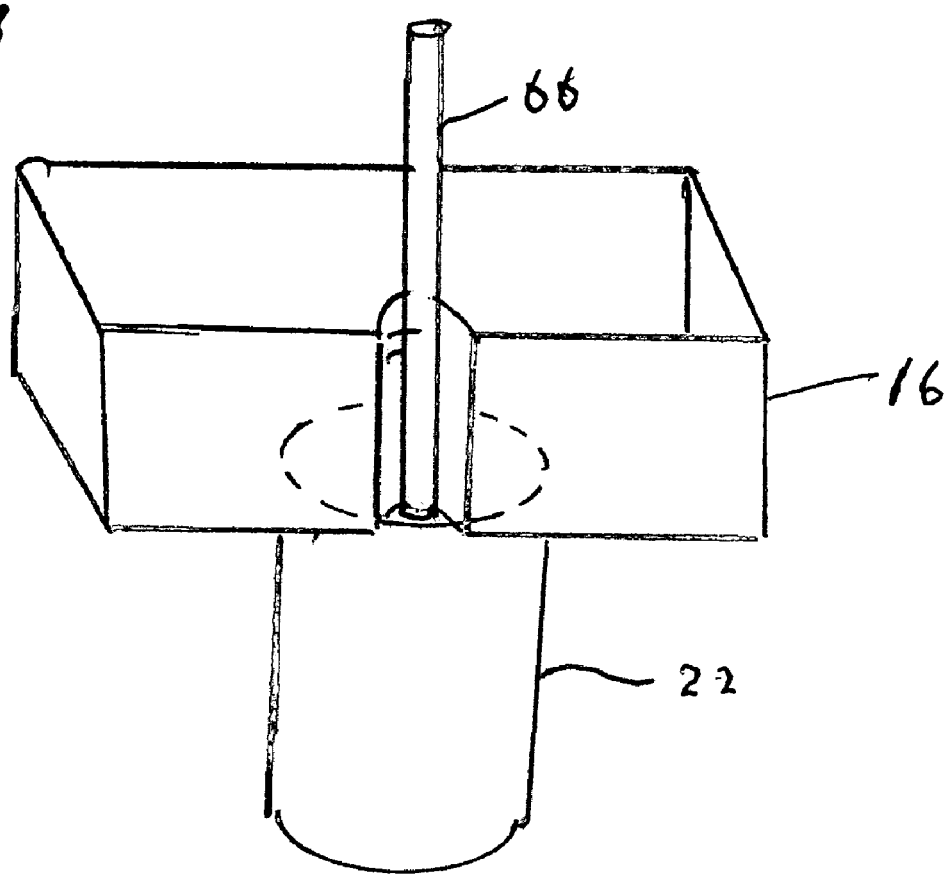
FIG. 3 shows a straw inserted through a groove in the side of the container.

Alternatively, as in FIG. 3, a side of the box has an indentation 23 that permits inserting a drinking straw 66 into an opening in the can 22.

FIGS. 1, 2A are perspective views of the lid poised for mounting onto the box 16 so as to enclose the hot dog inside the closed container 10.

Figure 4A:
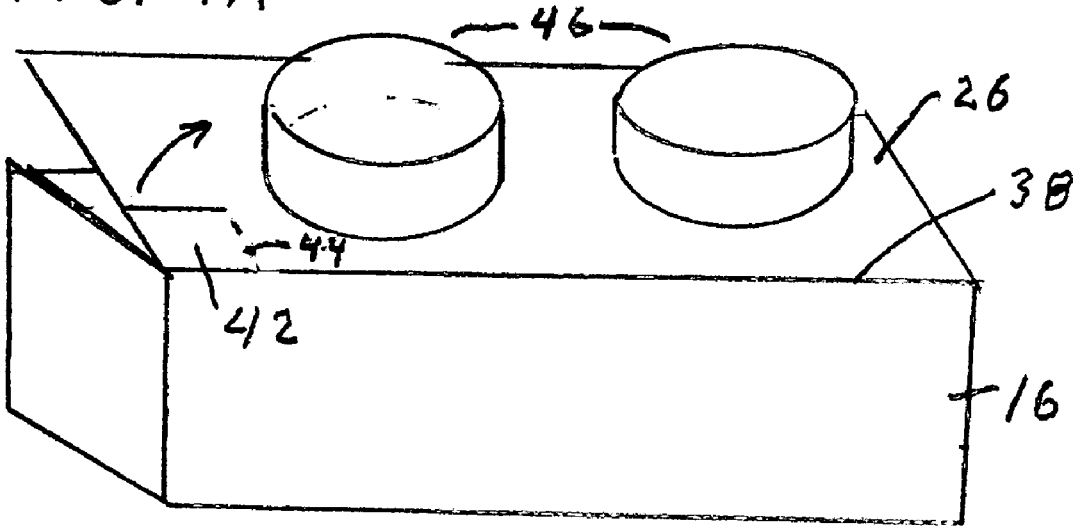
FIG. 4A shows depressions in the lid for holding sauces.

FIGS. 4A, B is a version in which one edge 38 of the lid 26 is joined to an edge of one side of the tray 16. A hot dog is stored or transported in the container 10 when the lid 26 is closed.

Figure 4B:
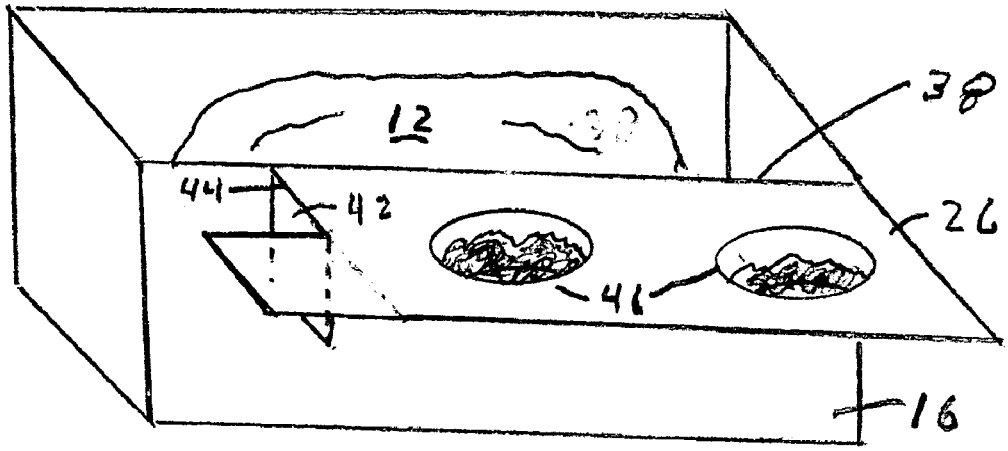
FIG. 4B shows the lid of FIG. 4A laid open to hold sauces.

In use, the lid is folded (rotated) away from the box 16 as shown in FIG. 4B.

A flange 42, partially cut out of lid 26 is folded (along dofted line 44) that braces the lid 26 in the open position.

FIG. 4B shows compartments 46 (depressions) formed in the lid 26. Each sauce may be deposited in its own compartment. The diner dispenses the sauce into its own compartment to start his feast. Then he may dip the end of his hot dog into the sauce (in the compartment).

Initially, packets of sauces may be placed inside the closed tray with the hot dog. Packaging, catsup and mustard in envelopes is well known in the art of packaging.

This construction provides several conveniences for the consuming public.

One convenience is that the beverage and/or hot dog can be dispensed while holding the container in one hand.

In the context of this specification, the term "sauce" is any semi-liquid appetizer normally applied to hot dogs, (catsup, mustard and relish, well known to the public.)

Variations and modifications of this invention may be contemplated after reading the specification and studying the drawings that are within the scope of this invention.

Figure 5:
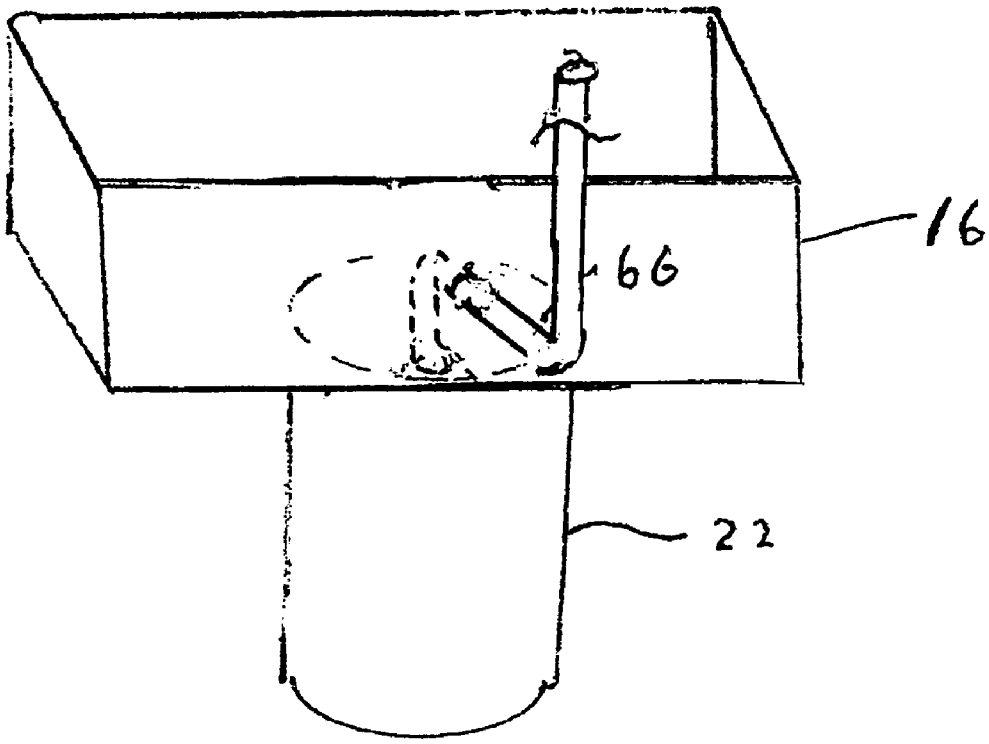
FIG. 5 shows a drinking straw extending through the side of the container

For example, FIG. 5 shows a drinking straw whose lower end (lower end not shown) is inserted into the can and whose upper end extends through an opening in the side of the container.

By following the disclosure of this invention, the hot dog and beverage are fully protected from contamination until the consumer is ready to consume the hot dog and beverage.

In the context of this specification, the term, bulk item of food, is intended to mean food that is not liquid and which a user can pick up with his fingers and bite off a portion. Such a bulk item means particularly a hot dog having an oblong shape and intended for the user to hold the item in one hand and bite portions of the item.

In view of these variations, it is therefore wished to define the scope of the invention by the appended claims.

What is claimed is:

1. A container for holding a bulk item of food, particularly a hot dog, and dispensing said container together with a standard cup/can holding a beverage, said cup/can having a ridge forming a rim on a top end of said can, said container comprising:

a tray having a bottom side and a continuous side extending from an edge of said bottom side;

said bottom side and continuous side defining an oblong interior region for holding said bulk item of food;

an edge of said continuous side defining an edge of said continuous side distal from said bottom side;

a circular groove formed on the bottom side of said tray configured to mate with the ridge on the rim of the can whereby the container is detachably secured on the can with said bottom side of said container on said standard can with said bottom side proximal to said can extending away from said container;

a lid having a bounding edge configured to mate with said rim of said continuous side wherein a straight section of said edge of said lid is integrally joined to a straight section of said rim of said continuous side enabling that, in one position, said rim covers said container and, in a second position, said lid is side by side with said container and said lid is positioned to enable a user to position sauce on said lid;

a flange on an edge of said lid adjacent to said straight section of said lid positioned to abut said extending side when said lid is in said second position whereby said lid is provided with support when said lid is in said second position;

said lid has at least one depression in said lid wherein each one of said at least one depression has a size permitting locating a sauce in said depression and allowing a user access to the sauce when said lid is in said second position.

2. The container of claim 1 wherein said sauce is any one of catsup, mustard, pickle relish and onion.

3. The container of claim 2 wherein said container is an injection molded thermoplastic.

* * * * *